United States Patent [19]

Kinomoto et al.

[11] 3,995,457

[45] Dec. 7, 1976

[54] CONTINUOUS PADDING TYPE DYEING MACHINE

[76] Inventors: Shigeru Kinomoto, 621, Shimokosaka, Hagashiosaka, Osaka; Katsuyuki Nishikawa, 28, Takayasu-cho Kita 2-chome, Yao, Osaka; Takao Ishida, 333, Mimura, Sango-cho, Ikoma, Nara, all of Japan

[22] Filed: Dec. 30, 1975

[21] Appl. No.: 645,470

Related U.S. Application Data

[63] Continuation of Ser. No. 483,441, June 26, 1974, abandoned.

[30] Foreign Application Priority Data

Apr. 30, 1974 Japan ..... 49-48598

[52] U.S. Cl. ..... 68/13 R; 26/76; 26/86; 26/92; 26/96; 26/105; 34/158; 68/19.1; 68/20; 68/22 R; 68/175

[51] Int. Cl.[2] ..... D06F 3/10; D06F 21/00

[58] Field of Search ..... 68/5 D, 5 E, 13 R, 19, 68/19.1, 20, 22 R, 175; 34/158; 26/76, 86, 92, 96, 105; 226/34, 24

[56] References Cited

UNITED STATES PATENTS

| | | | |
|---|---|---|---|
| 2,571,494 | 10/1951 | Spooner | 68/20 X |
| 2,637,659 | 5/1953 | Miller | 68/175 X |
| 2,724,254 | 11/1955 | Zanger | 68/19 X |
| 2,806,694 | 9/1957 | Penman | 226/34 X |
| 3,665,734 | 5/1972 | Hauser et al. | 68/20 X |
| 3,824,814 | 7/1974 | Fleissner | 68/20 X |
| 3,828,998 | 8/1974 | Gross | 26/105 X |

*Primary Examiner*—Philip R. Coe
*Attorney, Agent, or Firm*—Haseltine, Lake & Waters

[57] ABSTRACT

A continuous padding type dyeing machine particularly suitable for handling elastic fabrics, the machine including a padding bath with at least a pair of main and auxiliary padding rollers and a dryer having a pair of spaced endless conveyors means provided on opposite sides of a path of travel of the fabrics for transferring them through the dryer without causing excessive tensioning thereto. The endless conveyors are movable in and along a number of adjustable guide members and provided with a number of pin members for holding longitudinal side edge portions of the fabrics. A pair of detectors are provided at a lower end of a vertical section of the path of travel of the fabric through the dryer in association with opposite longitudinal side edges of the fabric for adapting the guide members to the particular width of the fabric under treatment.

10 Claims, 6 Drawing Figures

CONTINUOUS PADDING TYPE DYEING MACHINE

CROSS RELATED APPLICATION

This Application is a continuation of Application Ser. No. 483,441 filed June 26, 1974, and now abandoned, and claims the priority of the Application filed in Japan on Apr. 30, 1974.

This invention relates to a continuous dyeing machine for fabrics, especially fabrics having elastic construction such as like knit fabrics, and more particularly to a continuous dyeing machine of the padding type where fabric padded with a dye solution is successively subjected to drying and heat setting.

In general, knit fabrics have a coarse texture and relatively high elasticity so that they are susceptible of structural deformation or distortion while being passed through a dyeing machine.

In the existing continuous padding type dyeing machines, a fabric web is passed around a lower circumferential surface of a padding roller which is immersed in a dye solution in a padding bath and the fabric padded with the dye solution is led to a guide bar which is located above the padding bath and then compressed between a pair of squeezing rollers for adjusting the pick-up rate of the dye solution. The fabric leaving the squeezing rollers is led vertically upwardly toward drawing rollers which are positively rotated in a position above the squeezing rollers and dried by means of heaters which are located at suitable intervals on opposite sides of the path of travel of the fabric between the squeezing rollers and the drawing rollers. The prior art dyeing machine of the type just mentioned has a number of drawbacks. More particularly, the fabric web between the squeezing rollers and the guide bar is unduly tensioned since the guide bar is held standstill while the squeezing rollers are positively driven. Also, the web of fabric travelling between the guide bar and the roller in the padding bath experiences excessive tensioning due to frictional resistance of the roller bearings. The excessive tensioning of the fabric web invariably results in elongation of the knit yarns and therefore in impairment of the quality of the finally dyed product. Moreover, the fabric web padded with the dye solution has an increased weight so that the fabric in the vertical passage between the squeezing rollers and the drawing rollers is also tensioned by its own weight, causing elongation to the knit yarns of the fabric. Under these circumstances, the fabric web is curled or warped especially at its selvage or longitudinal side edge portions, resulting in insufficient drying of the longitudinal edge portions as compared with the center portions of the fabric. In addition, the center portions of the fabric are also warped toward or away from the heaters on one side of the fabric passage so that the fabric undergoes drying in different degrees in its transverse direction, causing migration of the dye solution to lower the quality of the fabric to a considerable extent.

It is therefore an object of the present invention to provide a continuous padding type dyeing machine which is adapted to carry out the padding and drying operations without applying excessive tension to the fabric web.

It is another object of the present invention to provide a continuous padding type dyeing machine which is capable of maintaining a fabric web in a fully spread state during the padding and drying operations without causing warping at the center and longitudinal side edge portions of the fabric to preclude uneven padding, non-uniform drying and migration of the dye solution.

According to the present invention, there is provided a continuous padding type fabric dyeing machine, including a padder for padding fabric with a dye solution, a dryer for drying the padded fabric and a heat setter for setting the fabric at a high temperature, the dyeing machine comprising a padding bath holding a dye solution therein, at least one main padding roller having a lower portion immersed in the dye solution in the padding bath and rotatable at a circumferential speed substantially the same as the speed of the feeding fabric, the main padding roller being adapted to pad the fabric with the dye solution while stretching the fabric widthwise, at least one auxiliary padding roller rotatable in pressed engagement with the main padding roller and forming a nip at a level higher than the surface level of the dye solution in the padding bath for compressing the fabric therebetween to provide a predetermined pick-up rate, a pair of endless conveying means movable in spaced relation from each other along a path of travel of the fabric in the driver and having a number of pin members projecting into the plane of travel of the fabric at predetermined intervals along the length thereof, the path of travel including a vertical section immediately above the padder, a pair of roller brushes located on opposite sides of the path of travel of the fabric at the lower end of the vertical section and held in contact with longitudinal edge portions of the fabric for urging the same to be pierced by said pin members of said endless conveying means, and a pair of heat sources located on opposite sides of the path of travel for applying heat to the fabric from opposite sides thereof, the heat setter having a heating chamber establishing a heated atmosphere around the fabric for setting the same at a high temperature.

The above and other objects, features and advantages of the invention will become clear from the following description and the appended claims, taken in conjunction with the accompanying drawings which show by way of example a preferred embodiment of the invention and wherein:

Figure 1:
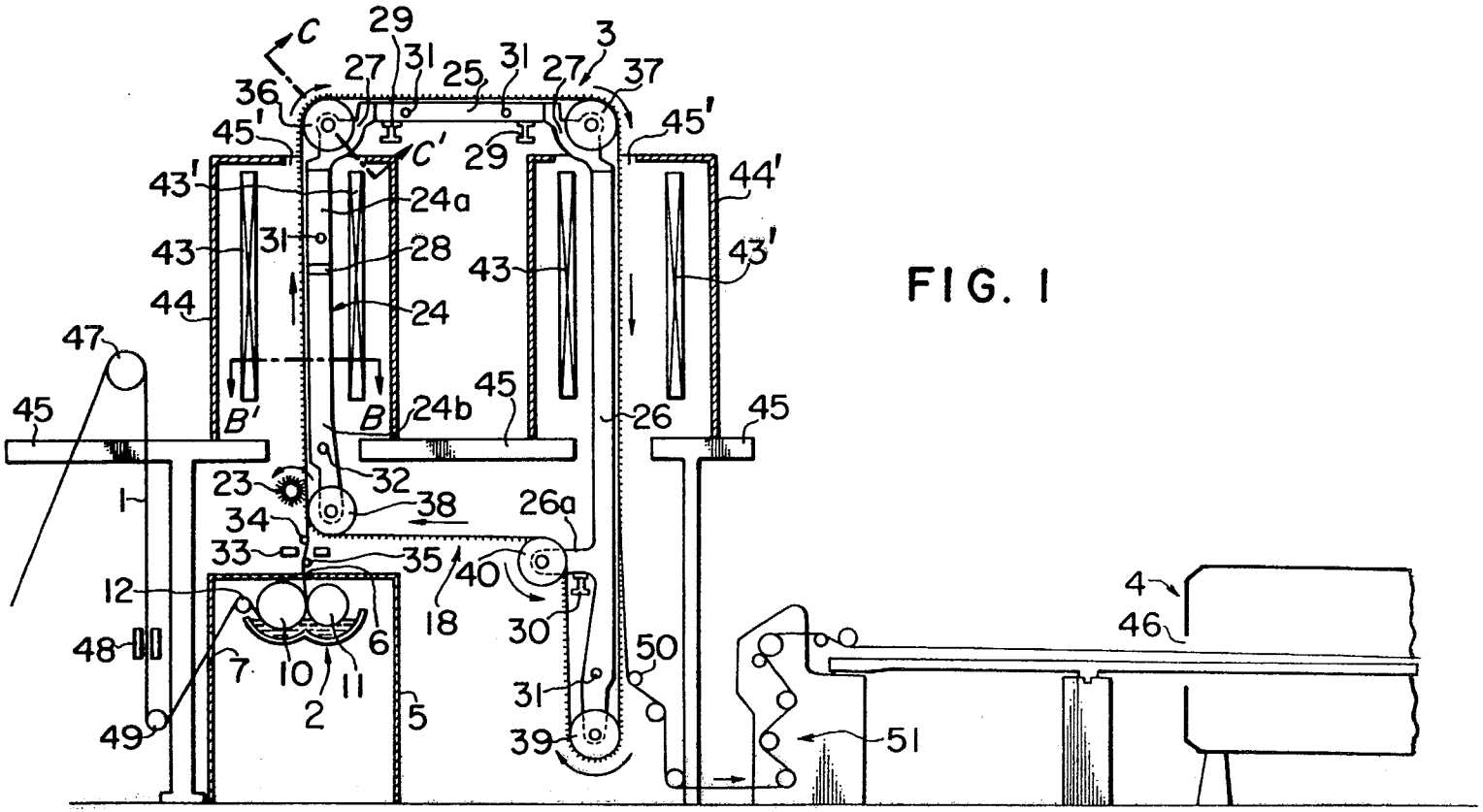
FIG. 1 is a side view partially in section of a continuous dyeing machine embodying the present invention.

Referring to the accompanying drawings and first to FIG. 1, the continuous dyeing machine according to the present invention generally includes a padder 2 for padding a length of fabric 1 with a dye solution, a dryer 3 drying the padded fabric, and a heat setter 4 for setting the fabric 1 by application of a high temperature. The padder 2 is housed in a casing 5 and is formed with openings 6 and 7 in the upper and side walls thereof, respectively. The padder 2 comprises, as shown particularly in FIG. 2, a padding bath 9 which is filled with a dye solution 8, main padding roller 10 which has its lower side immersed in the dye solution 8, an auxiliary padding roller 11 which is held in pressed engagement with the main roller 10, and a stretcher roller 12 which is employed for stretching the fabric 1 to withwise before its entry into the dye solution in the padding bath 9. The padding bath 9 has its bottom wall formed arcuately substantially in parallel with or at a predetermined distance from the circumferential surface of the main roller 10. The padding bath 9 thus can hold therein the dye solution 8 in a minimum amount necessary for padding the fabric 1. It will be appreciated that this particular design of the padding bath 9 reduces the losses which would incur when replacing one dye solution extended up to a level immediately below the auxiliary roller 11 and the stretcher roller 12, respectively, and is provided on the side of the auxiliary roller 11 with an arcuate extension which extends outwardly from the main padding roller 10 substantially in parallel to or at a predetermined distance from the circumferential surface of the auxiliary roller 11, for receiving the excessive dye solution which is carried away with the fabric 1 and drops therefrom onto the circumferential surface of the auxiliary roller 11. The dye solution received by the extension is returned by gravity to the bath 9 which is located at a lower level.

Figure 3:
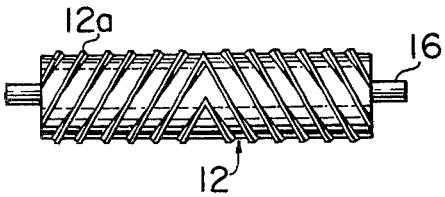
FIG. 3 is a plan view of a stretcher roller as seen on line A—A of FIG. 1.

The circumferential surface of the main and auxiliary padding rollers 10 and 11 are covered with a resilient material such as rubber, synthetic resin or the like in order not to damage the fabric 1. Alternatively, the main and auxiliary rollers 10 and 11 may be formed entirely from a resilient material, if desired. The main and auxiliary rollers 10 and 11 are mounted in position in such a manner that they have a nip position above the surface level of the dye solution in the padding bath 9, and they are pressed against each other to squeeze out excessive dye solution from the fabric 1 which is passed therebetween. Preferably, the padding bath 9 should contain the dye solution 8 in a large amount but, in order to ensure the squeezing effects by the main and auxiliary rollers 10 and 11, the surface level of the dye solution 8 should aways be maintained below the nip position of the main and auxiliary padding rollers as mentioned hereinbefore, since otherwise a web of fabric which has been padded with a predetermined amount of the dye solution by the squeezing operation of the main and auxiliary padding rollers 10 and 11 would be impregnated again with excessive dye solution. The main and auxiliary padding rollers 10 and 11 are supported on rotating shafts 14 and 15, respectively, and are rotated at a circumferential speed substantially same as the speed of travel of the fabric 1 by driving the main roller shaft 14 with use of a suitable driving means (not shown). In the present invention, the shaft 15 of the auxiliary roller 11 may also be positively driven such that the auxiliary roller 11 has the same circumferential speed as the main padding roller 10. The stretcher roller 12 is mounted in position opposingly to and at a suitable distance from the main padding roller 10 and circumferentially formed with a number of linear projections 12 a which extend helically from the center toward the opposite ends of the roller 12 (see FIG. 3). These helical surface projections 12*a* are intimately contacted with the fabric 1 and serve to stretch the fabric widthwise when the stretcher roller 12 is rotated in the direction indicated by arrow *a* by a suitable driving means (not shown) which is operatively connected to a rotating shaft 16 of the stretcher roller 12. The stretcher roller 12 is driven at a circumferential speed 1 to 3 times, preferably 1.5 to 2.5 times greater than that of the main and auxiliary rollers 10 and 11 to give satisfactory stretching effects on the fabric 1. The widthwise stretching effect is appreciably lowered when the circumferential speed of the stretcher roller 12 becomes smaller than that of the main and auxiliary rollers 10 and 11. On the other hand, if the circumferential speed of the stretcher roller 12 is more than three times greater than that of the padding rollers 10 and 11, the fabric 1 on the stretcher roller 12 tends to be forcibly pulled toward one end of the roller 12. The experiments carried out by the present inventors revealed that the most satisfactory widthwise stretching effects can be obtained when the circumferential speed of the stretcher roller 12 is 1.5 to 2.5 times greater than the circumferential speed of the main and auxiliary padding roller 10 and 11, without entailing widthwise deviations of the fabric 1.

Figure 2:
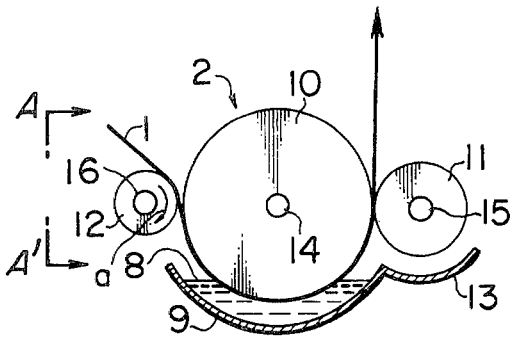
FIG. 2 is a side view partially in section showing on an enlarged scale a padder employed in the dyeing machine of the invention.

If desired, the stretcher roller 12 may be rotated in a direction opposite to arrow *a* of FIG. 2. In such a case, the linear surface projections 12*a* of the roller 12 are provided in the form of helices of opposite directions with respect to the particular example shown in FIG. 3 and the angle of contact of the fabric 1 with respect to the stretcher roller 12 should preferably be made smaller. The circumferential speed of the stretcher roller 12 relative to the main padding roller 10 may be in the same ratio as mentioned hereinbefore.

Figure 4:
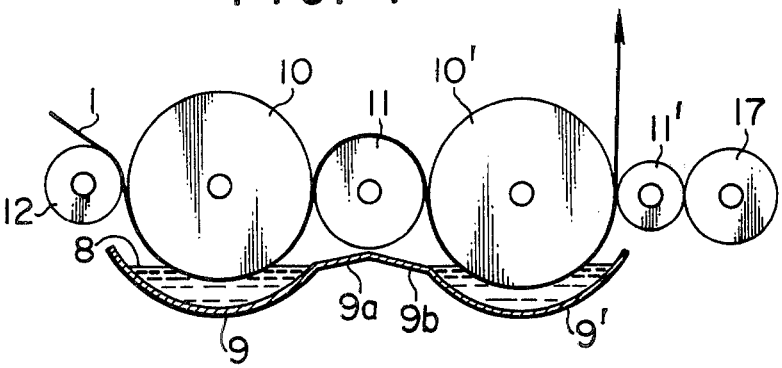
FIG. 4 is a side view partially in section showing on an enlarged scale a modified construction of the padder.

Alternatively, the padder 2 may be constructed as shown in FIG. 4. More particularly, there may be provided two pairs of main and auxiliary rollers 10, 10' and 11, 11' in combination with a pair of round-bottomed padding baths 9 and 9' which are located beneath the respective main padding rollers 10 and 10'. The padding baths 9 and 9' are connected with each other by means of sloped sideward extensions 9*a* and 9*b* which are located beneath the auxiliary roller 11 between the main padding rollers 10 and 10'. In this instance, the auxiliary roller 11' at the righthand side of the main roller 10' has a smaller diameter than the auxiliary roller 10 of FIG. 2 to have a reduced nip or contact area for ensuring more uniform and accurate squeezing operation. The auxiliary roller 11' is pressed against the main roller 10' by means of a pressure roller 17 as otherwise the auxiliary roller 11' will be warped due to its reduced diameter. If desired, the auxiliary rollers 11 and 11' may be of the same diameter as the main rollers 10 and 10'.

Figure 5:
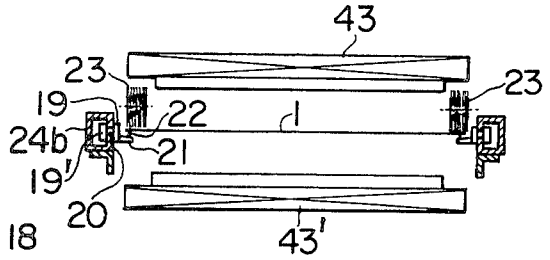
FIG. 5 is an enlarged sectional view taken on line B—B of FIG. 1.
Figure 6:
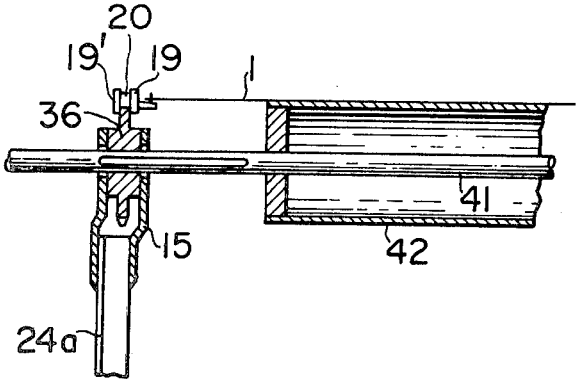
FIG. 6 is an enlarged sectional view taken on line C—C of FIG. 1.

Referring again to FIG. 1, the dryer 3 includes a pair of endless roller chains 18 on opposite sides of a path of travel of the fabric 1 for transferring the same through the dryer 3, the path of travel of the fabric 1 including a vertical section at least immediately above the padder 2. The endless chains 18 are adapted to travel in and along a substantially square passage as shown in FIG. 5 and are constituted by a number of chain units each having a pair of opposing roller link plates 19 and 19' and rollers 20 in the usual manner. The chain 18 is embraced in grooves of guide members which will be described herein latter. The inner roller link plates 19 which are exposed to the path of travel of the fabric are provided with a number of projections 21 at suitable interval along the length of the chain 18, each one of the projections 21 having fixed thereto a sharply pointed pin 22 perpendicularly to a plane along which the fabric 1 is conveyed. A pair of roller brushes 23 are located in contact with opposite longitudinal side edges of the fabric 1 in the lower portion of the vertical fabric passage above the padder 2, as shown in FIGS. 1 and 5, so that the fabric 1 which has been padded with the dye solution 8 is pierced by the pins 22 of the roller chains 18 upon entrance into the vertical travel section. Preferably, the brush roller 23 is formed from horse tail hair but it may be formed from other threads of filaments of similar strength, if desired. Further, the roller brushes 23 may be rotated by frictional contact with the pins 22 and fabric 1 or may be positively driven by a suitable means. A number of chain guide members as at 24, 25 and 26 are provided along the passage of the endless chains 18 as shown in FIG. 1, which guide members 24 to 26 are linked to each other by means of link members 27. The vertical guide member 24 has an upper guide portion 24*a* and a lower guide portion 24*b* which are connected to each other by means of a hinge 28 to allow inward or outward swinging movement of the lower guide portion 24*b*. The upper horizontal guide member 25 is slidably mounted on rail members 29, while the other vertical guide member 26 has an arm portion 26*a* rested on a rail member 30 for sliding movement therealong. The chain guide members 25 and 26 and the upper guide portions 24*a* of the vertical guide member 24 which on opposite sides of the passage of the fabric 1 are in threaded engagement with end portions of transverse screw shafts 31 which have screw threads of opposite directions so that the distance between the guide members 25 and 26 and the upper guide portions 24*a* may be adjusted by rotating the screw shafts 31 in either forward or reverse direction to cope with the particular width of the fabric to be handled, with use of a suitable driving means (not shown). In addition, the lower guide section 24*b* of the vertical guide member 24 is in threaded engagement with a pair of independent screw shafts 32 which are adapted to be rotated by respective driving means (not shown) to impart inward or outward swinging movement to the lower guide section 24*b* of the vertical guide member 24. Suitably, the rotational movement of the screw shafts 32 is controlled by a fabric width detector 33 which is provided between the lower guide section 24*b* of the vertical guide member 24 and the padder 2. The fabric width detector 33 includes, in the particular example shown, a photoelectric detector provided on each side of the passage of the fabric 1 for controlling the driving means of the screw shaft 32 such that the lower guide section 24*b* of the vertical guide member 24 is moved inwardly or outwardly to adapt itself to variations in width of the fabric 1. For this purpose, there may be employed a detector using injected air flows or a feeler means contacting longitudinal edges or selvages of the fabric 1 instead of the photoelectric detector just mentioned, if preferred. In this connection, the detector 33 is provided with a pair of transverse guide bars 34 and 35 which serve to stretch the fabric 1 to its full width to allow accurate detection of the travel positions of the longitudinal side edges or selvages of the fabric 1. The similar effects can be obtained by using rollers instead of the guide bars 34 and 35. The endless chains 18 are engaged with sprocket wheels 36 and 37 which are rotatably mounted on the link members 27, sprocket wheels 38 on the lower guide sections 24*b* of the first vertical guide members 24 and sprocket wheels 39 and 40 on the second vertical guide member 26. At least one of the sprocket wheels 36 through 40 is driven from a suitable means for driving the endless chains 18 at a speed substantially same as the circumferential speed of the main padding roller 10. The sprocket wheel 36 is, for example, keyed to a rotating shaft 41 which carries a drum 42 for guiding the fabric 1, as shown in FIG. 6. In the example shown, the other sprocket wheels 37 to 40 are mounted on respective rotating shafts with guide drums in a similar manner. Heat sources 43 and 43' are located on opposite sides of the passage of the fabric 1 at a suitable distance therefrom and may be infrared or gas heating means. The heaters 43 and 43' are accommodated in housings 44 and 44', respectively, which are provided with openings 45' to allow passage therethrough of the fabric 1 and mounted on a support table 45.

The high temperature setting device 4 has an inlet opening 46 for introducing the fabric 1 into its interior which is maintained at a high temperature.

In operation, the fabric 1 is passed around a freely rotatable roller 47 and gripped at opposite longitudinal edge portions by disc type stretching guides 48 which are provided below the roller 47. Past the guides 48, the fabric 1 is introduced into the padding bath 9 by way of a roller 49. The fabric which has been introduced into the padder 2 is firstly spread to its full width by means of the stretcher roller 12 and then immersed in the dye solution 8 for padding while being held in contact with the lower circumferential surface of the main padding roller 10. Since the fabric 1 is fed at a speed substantially same as the circumferential speed of the main roller 10, there is almost no possibility of the fabric 1 being curled or unduly tensioned. Therefore, the loops of the knit fabric are free from forcible stretching or elongation due to tensioning. The fabric 1 is compressed when passed between the main and auxiliary padding rollers 10 and 11 so that the dye solution is padded at a predetermined pick-up rate. In this instance, as the circumferential portion of the main and auxiliary padding rollers 10 and 11 are formed from a resilient material, the fabric 1 is not damaged. After leaving the padder 2, the fabric 1 moves upwardly and enters the dryer 3, whereupon the pins 22 of the respective endless chains 18 are deeply pierced into the longitudinal edge portions of the fabric 1 under the influence of the action of the roller brushes 23 to hold the fabric 1 securely on the chains 18. In the meantime, photoelectric detector 33 detects the positions of the respective longitudinal side edges of the fabric 1 and causes the screw shaft 32 to rotate in either direction to move the lower guide sections 24*b* of the first vertical guide members 24 in a transverse direction to follow the longitudinal side edges of the fabric 1 for the purpose of preventing prohibitive tensioning or slackening of the fabric 1 and piercing the pins 22 in predetermined side edge portions thereof. In this instance, the fabric 1 is securely held on the chains 18 by means of the respective pins 22 during travel through the dryer 3 so that the weight of the padded fabric 1 is borne by the respective pin members 22 to preclude excessive tensioning of the fabric 1. Moreover, since the pin members of the opposing endless chains 18 are spaced from each other by a distance which is substantially equal to the width of the fabric 1, no drooping or slackening occurs in the middle portion of the fabric 1. The exemption of the fabric 1 from excessive tensioning and drooping in the middle or longitudinal side edge portions of the fabric 1 can contribute to the elimination of elongation of loops of the knit yarns, migration of the dye solution and uneven drying. At the end of the upper horizontal passage of the dryer 3 the fabric 1 is turned downwardly and conveyed along the second downward vertical passage through heaters 43 and 43'. Upon leaving the heaters 43 and 43', the fabric 1 is disengaged and separated from the pin members 22 of the respective endless chains 18 in the vicinity of a guide bar 50 which is offset by a small distance from the plane of travel of the endless chains 18. The fabric 1 which has been separated from the endless chains 18 is transferred through a number of guide rollers 51 to the heat setter 4 for receiving a predetermined heat setting treatment and then to a subsequent process, if any.

It will be appreciated from the foregoing description that, according to the present invention, the tension of the fabric during the drying stage is held to a minimum without causing drooping to the middle as well as longitudinal side edge portions of the fabric. In other words, the fabric undergoes the drying treatment in a fully stretched state to obtain a final product of high quality which is completely free from uneven padding and migration of the dye solution and at the same time from non-uniform drying.

What is claimed is:

1. A continuous dyeing machine for fabric including a padder for padding fabric with a dye solution, a dryer for drying the padded fabric and a heat setter for setting the fabric at a high temperature, said dyeing machine comprising:

a padding bath holding a dye solution therein;

at least one main padding roller having a lower portion immersed in said dye solution in said padding bath and rotatable at a circumferential speed substantially the same as the feeding speed of the fabric, said main padding roller being adapted to pad the fabric with said dye solution while stretching said fabric widthwise;

at least one auxiliary padding roller rotatable in pressed engagement with said main padding roller and forming a nip at a level higher than the surface level of said dye solution in said padding bath for compressing the fabric therebetween to have a predetermined pick-up rate;

a pair of spaced endless conveying means movable along a path of travel of said fabric in said dryer and having a number of pin members projecting into the plane of travel of said fabric at predetermined intervals along the length thereof, said path of travel including a vertical section immediately above said padder;

a pair of roller brushes located at the lower end of said vertical section and held in contact with longitudinal edge portions of said fabric for urging the same to be pierced by said pin members of said endless conveying means; and a pair of heat sources located on opposite sides of said path of travel for applying heat to said fabric from opposite sides thereof;

said heat setter having a heating chamber establishing a heated atmoshphere around said fabric for setting the same at a high temperature.

2. A continuous dyeing machine as defined in claim 1, wherein said fabric has a knit construction.

3. A continuous dyeing machine as defined in claim 1, further comprising a stretcher roller located in spaced relation from said main padding roller on the opposite side of said auxiliary padding roller and including circumferentially formed linear surface projections extending helically towards opposite ends thereof, said stretcher roller being rotatable with the circumferential surface thereof in contact with said fabric to stretch the same widthwise.

4. A continuous dyeing machine as defined in claim 3, wherein said stretcher roller is rotatable at a circumferential speed 1 to 3 times greater than that of said main padding roller.

5. A continuous dyeing machine as defined in claim 1, wherein said padding bath has an arcuate bottom extending at a certain distance from the circumferential surface of said main padding roller, said bath having upper edges defining a maximum level for dye solution in said bath, said main and auxiliary padding rollers being positioned in said bath so that said nip therebetween is located above said upper edges of said bath and will always be above the level of said dye solution in said bath.

6. A continuous dyeing machine as defined in claim 1, wherein said main and auxiliary padding rollers have at least circumferential portions thereof formed from a resilient material.

7. A continuous dyeing machine as defined in claim 1, further comprising a pair of detector means located in the vicinity of opposite longitudinal side edge portions of said fabric between said padder and said lower end of said vertical section of said path of travel in said dryer, guide means located along and on opposite sides of said path of travel of said fabric for guiding said endless conveying means, and means operatively connected to said detector means for moving said guide means inwardly and outwardly in accordance with the positions of said longitudinal side edges of said fabric under detection of said detector means.

8. A continuous dyeing machine as defined in claim 7, further comprising at least one guide bar or roller located in the vicinity of said detector means for stretching said longitudinal side edge portions of said fabric under detection by said detector means.

9. A continuous dyeing machine as defined in claim 1 wherein said roller brushes and endless conveying means are disposed on opposite sides of said fabric.

10. A continuous dyeing machine as defined in claim 9 wherein said brushes are aligned with the path of travel of said pin members.

* * * * *

UNITED STATES PATENT AND TRADEMARK OFFICE

CERTIFICATE OF CORRECTION

PATENT NO. : 3,995,457
DATED : December 7, 1976
INVENTOR(S) : KINOMOTO ET AL

It is certified that error appears in the above-identified patent and that said Letters Patent are hereby corrected as shown below:

Please insert assignees,

--Teijin Limited and Hirano Kinzoku Company Limited, Osaka, Japan --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*